US005449080A

United States Patent [19]

Finke

[11] Patent Number: 5,449,080

[45] Date of Patent: Sep. 12, 1995

[54] METHODS AND COMBINATIONS FOR SEALING CORKED BOTTLES

[76] Inventor: Stephan J. Finke, 542 Avenue Del Oro, Sonoma, Calif. 95476

[21] Appl. No.: 374,810

[22] Filed: Jan. 19, 1995

Related U.S. Application Data

[63] Continuation of Ser. No. 98,744, Jul. 28, 1993, which is a continuation of Ser. No. 842,237, Feb. 26, 1992, abandoned, which is a continuation-in-part of Ser. No. 814,863, Dec. 30, 1991, abandoned.

[51] Int. Cl.[6] ..... B65D 39/00

[52] U.S. Cl. ..... 215/233; 215/273; 215/364

[58] Field of Search ..... 215/233, 230, 273, 364

[56] References Cited

U.S. PATENT DOCUMENTS

| | | |
|---|---|---|
| 37,962 | 3/1863 | Hicks . |
| 403,076 | 5/1889 | Sands . |
| 451,137 | 4/1891 | Schroeder . |
| 505,301 | 9/1893 | Schroeder . |
| 579,013 | 3/1897 | Schenker . |
| 596,366 | 12/1897 | Graham . |
| 604,443 | 4/1898 | Walker . |
| 610,535 | 9/1898 | Hensler . |
| 677,900 | 7/1901 | Stern . |
| 714,326 | 11/1902 | Parks . |
| 724,794 | 4/1903 | Brewington . |
| 755,573 | 3/1904 | Hoops . |
| 895,907 | 8/1908 | Spiller . |
| 944,030 | 12/1909 | Giffin . |
| 1,103,737 | 7/1914 | Budlong . |
| 1,116,663 | 11/1914 | Woodruff . |
| 1,146,036 | 7/1915 | Spinks . |
| 1,296,283 | 3/1919 | Gillinder . |
| 1,313,503 | 8/1919 | Petersen . |
| 1,377,568 | 5/1921 | Ellis et al. . |
| 1,731,194 | 5/1925 | Ellis . |
| 1,973,758 | 9/1934 | Gray et al. . |
| 2,228,936 | 1/1941 | Walter . |
| 2,305,361 | 12/1942 | Tanner . |
| 2,370,535 | 2/1945 | Harrison . |
| 2,741,388 | 4/1956 | Rubin . |
| 3,235,111 | 2/1966 | Whitton, Jr. et al. . |
| 3,984,022 | 10/1976 | Babiol ..... 215/355 |

*Primary Examiner*—Allan N. Shoap
*Assistant Examiner*—Vanessa Caretto
*Attorney, Agent, or Firm*—Dergosits & Noah

[57] ABSTRACT

A disc made of thermoplastic material is inserted into the neck of a corked bottle and placed upon the top of the cork so that when the disc is partially melted, it forms a water resistant seal with the interior surface of the bottle neck and the cork. In forming the seal, the entire disc remains inside the bottle neck leaving the exterior of the bottle free from messy or harmful residue. The interior surface of the bottle neck may be straight or beveled at an obtuse angle. If the interior surface of the bottle neck is beveled, a disc with a frusto conical configuration is used in the method. A cover layer can be adhered to the top of the wax disc for ornamentation and labeling purposes.

9 Claims, 2 Drawing Sheets

METHODS AND COMBINATIONS FOR SEALING CORKED BOTTLES

CROSS REFERENCE TO RELATED APPLICATION

This is a continuation of pending prior U.S. application Ser. No. 08/098,744 filed Jul. 28, 1993 which is a continuation of U.S. application Ser. No. 07/842,237, filed on Feb 26, 1992, now abandoned, which is a continuation-in-part of U.S. appliction Ser. No. 07/814,863, filed on Dec. 30, 1991, now abandoned.

TECHNICAL FIELD OF THE INVENTION

The present invention relates to methods for sealing corked bottles, and in particular for sealing corked bottles containing beverages including wines.

BACKGROUND OF THE INVENTION

Existing methods of sealing corked bottles have several disadvantages. One current method of sealing corked bottles requires the use of thin metal foils containing lead, which are now widely believed to leave traces of harmful lead particles on the glass surface of the bottle after removal. In view of the recent bans in many states on the use of lead, this method is undesirable.

Another conventional method utilizes seals made of plastic. This is undesirable for many products because plastic seals are not considered suitable for premium beverages, including higher-priced wines.

Current methods have also attempted to employ wax seals. However, the current method involves forming wax seals by dipping the opening and neck of the bottle in wax. This method has the disadvantages of requiring the bottle to be inverted during the sealing process and of leaving a messy residue of wax when the bottle is opened.

All of the conventional sealing methods described above result in seals which cover all or most of the exterior of the glass neck of the bottle with the sealing material.

In contrast to the existing sealing methods, this invention will not leave any harmful or messy residue on the exterior of the bottle neck, will produce an elegant seal suitable for use on premium beverage bottles, including higher-priced wines, and will leave the entire exterior surface of the glass neck of the bottle exposed. It will also allow for the use of embossing on the wax seal.

SUMMARY OF THE INVENTION

One object of the present invention is to provide a method for sealing a corked bottle which utilizes a cylindrical wax disc which is inserted into the mouth of the neck of a corked bottle and placed on top of the cork. The bottle neck is heated so that the disc partially melts and forms a seal with the interior surface of the bottle neck and the cork. In the preferred embodiment, this is accomplished by heating the bottle neck prior to the insertion of the wax disc.

Another object of the present invention utilizes a frusto conical disc which is inserted into the mouth of the neck of a corked bottle where the interior surface of the mouth is beveled. The bottle neck is heated so that the disc melts and forms a seal with the beveled interior surface of the bottle neck and the cork. In the preferred practice of the is method, the bottle neck is heated prior to the insertion of the wax disc.

Yet another object of the present invention is to provide a cover layer on top of the disc which has the ability to accept fine print or embossed designs.

Objects and advantages other than those set forth above will be apparent from the following description when read in conjunction with the accompanying drawings.

BRIEF DESCRIPTION OF THE DRAWINGS

In FIGS. 1–3, the same reference numerals are being used to refer to the same elements shown in different views.

DETAILED DESCRIPTION OF THE INVENTION

Figure 1:
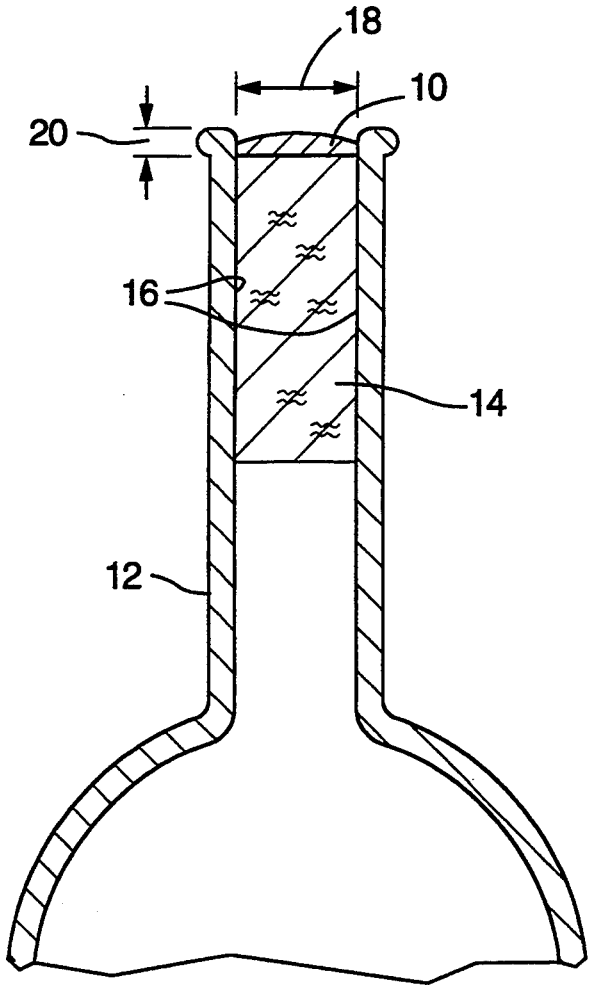
FIG. 1 is a cross-sectional view of a neck of a conventional corked bottle showing a cork and the disc positioned therein according to the first embodiment.
Figure 2:
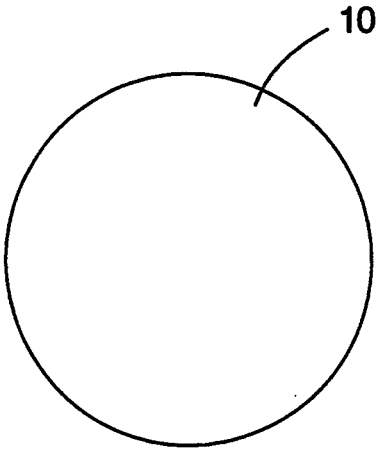
FIG. 2 is a top view of the disc of the first embodiment.
Figure 3:
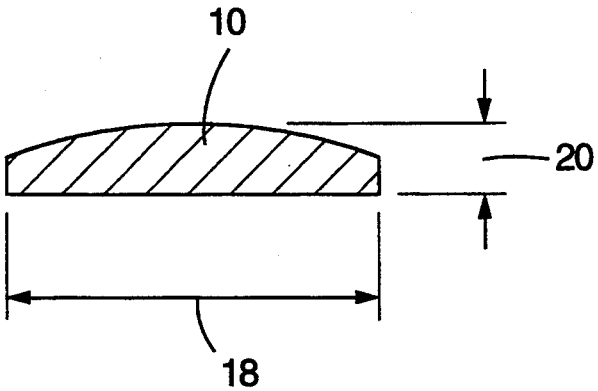
FIG. 3 is a cross-sectional view of the disc of the first embodiment.

The present invention is directed to a method for sealing a corked bottle. As shown in FIGS. 1 & 2, this sealing method utilizes a cylindrical disc 10 of a slightly smaller diameter than the inside diameter of the bottle neck 12 into which it will be placed, measured at the point in the bottle neck at which the top of the cork 14 lies. The disc 10, according to FIG. 3, is flat on the bottom and may be crowned or flat on the top, with a total height 20. As shown in FIG. 1, the height 20 of the disc is selected so that when the disc 10 is partially melted and removably secured to the top of the cork 14 and the interior surface 16 of the bottle neck, all of the disc material is contained entirely within the bottle neck. This alleviates the messy or harmful residue on the exterior of the bottle that occurs when bottles are sealed according to the current methods. The preferred embodiment of the claimed method utilizes a disc with a total height 20 of 2 to 3 mm. In this preferred embodiment, the disc 10 resides entirely below the mouth of the bottle neck 12. This permits shipping of the bottles upside down without damaging the top of the wax chip.

The disc is made of a thermoplastic material, which will melt and seal inside of the bottle neck under temperature conditions compatible with beverage manufacture and handling. A suitable melting point is between 80° and 180° F. The thermoplastic material should also be chosen in light of prevailing standards for the contact of materials by foods and beverage products. Non-toxic, substantially inert materials are preferred for this application. The disc should also be made of a thermoplastic material which will cleanly release its seal when it is removed from the bottle neck with the cork. Ideally, the thermoplastic material will not crumble or substantially fracture when pierced with a cork screw.

In a particularly preferred embodiment, the disc is comprised of a material which can accept and hold an embossed design on the top of the disc, for example, a logo or design embossed on the disc.

There is a large number of thermoplastic materials, both natural and organically synthesized, which will fit the above-noted criteria for the disc. Natural beeswax is a preferred material because of its demonstrated compatibility with food and beverage products. One disadvantage, however, of beeswax is its low melting point which make handling and storage difficult. Another preferred wax is granulate which would be suitable for high speed assembly line use of the disc.

In the selection of a thermoplastic material for the disc, the ability of the disc to retain an embossed design after heating to create the seal should be considered. In other words, a material should be selected which can be sealed by contact with a heated bottle neck but which will not lose the pre-embossed design under these temperature conditions. For this reason, it is conceived that an aggregation or combination or mixture of materials may provide a suitable disc construction.

The selection of thermoplastic materials suitable for the disc from among organic polymer thermoplastic materials and from among naturally occurring wax materials is within the skill of the ordinary artisan.

Figure 4:
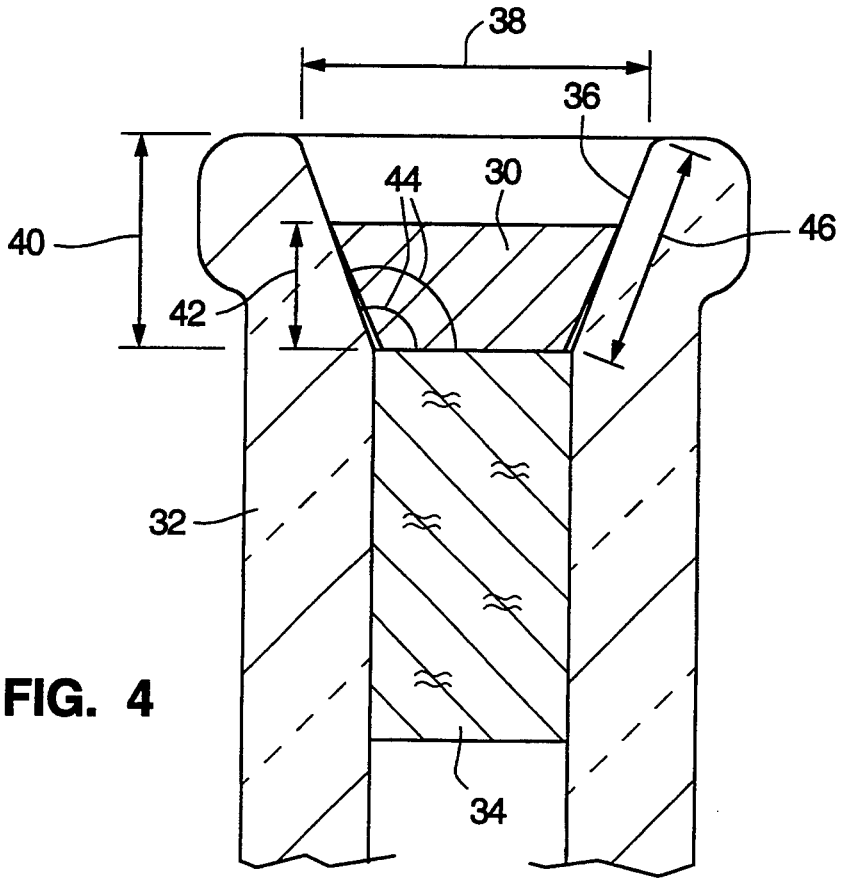
FIG. 4 is a cross-sectional view of a neck of a corked bottle showing a cork and the disc positioned therein according to a second embodiment.
Figure 5:
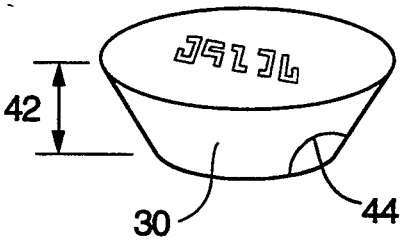
FIG. 5 is a perspective view of a disc having a frusto conical configuration in accordance with the second embodiment. The same reference numerals used in FIG. 4 are used in FIG. 5 to refer to the same elements.

One potential disadvantage of this method using a bottle with a straight interior neck surface 16, as seen in FIG. 1, is that when the disc 10 is inserted into the mouth 18 of the bottle by hand or by automatic dispenser, the disc 10 may get hung up on the interior neck surface 16 so that the disc 10 is oriented at an angle to the cork 14 top surface. This misplacement may prevent the disc from forming a moisture resistant seal with the interior surface 16 of the bottle neck 12. To avoid this potential problem, the sealing method of the present invention, according to a second embodiment, utilizes a bottle as shown in FIG. 4, in which the interior neck surface 36 near the mouth 38, is beveled at an obtuse angle 44 measured from the horizontal axis of the neck 32. As shown in FIG. 4, the disc 30 utilized in this embodiment has a frusto conical configuration where the obtuse angle 44 is substantially equivalent to the obtuse angle 44 of the beveled interior neck surface 36. This is so the disc 30 will tend to center itself above the cork 34 when inserted into the bottle mouth 38 by hand or by automatic dispenser. The frusto conical disc 30 has a flat bottom with either a flat top, a crowned top or any shape desired by the bottle sealer. The disc 30 is fabricated from a thermoplastic material such as those described above the reference to the first embodiment.

In FIG. 4, the length 46 of the beveled interior. neck surface 36, measured from the mouth 38 of the bottle to the top of the cork 34, may vary depending upon the obtuse angle 44 of the beveled, interior neck surface 36. For example, the interior neck surface 36 may be beveled at an obtuse angle 44 of 100 degrees with the length of the beveled surface 46 approximately 4 millimeters. The selection of the bevel angle is determined by the overall bottle design. The magnitude of this angle is not critical to the practice of the present invention.

In practicing a preferred embodiment of the claimed method, as seen in FIG. 4, the cork 34 is inserted into the bottle neck 38 so that the distance 40 from the top of the cork 34 to the top edge of the mouth 38 of the bottle is at least 1 millimeter greater than the height 42 of the disc 30. The advantages of this are twofold. First, this prevents any of the disc material from melting over the mouth 38 of the bottle and onto the exterior of the bottle neck during the sealing process. Second, this permits the bottles to be stored and shipped upside down with each bottle supported on the edge of the opening of the bottle neck without putting pressure on the disc 30.

There are two ways of performing the claimed method. One way is to insert the disc into the bottle neck so it rests upon the cork top surface before heating the bottle neck. The bottle neck is then heated for a period of time so that the interior surface of the bottle neck and the top surface of the cork are hot enough to partially melt the outer surface of the disc, causing it to adhere to the interior neck surface of the bottle neck and the top surface of the cork. This method may require the use of a disc with a composite structure so that the application of heat after the insertion of the disc will not cause the embossed design to melt and to obscure. This method, however, may be used when no embossing is present.

Alternatively, and preferably, the bottle neck is heated before the disc is inserted therein, so that any brand identification embossed on the top of the disc is preserved without damage.

Figure 6:
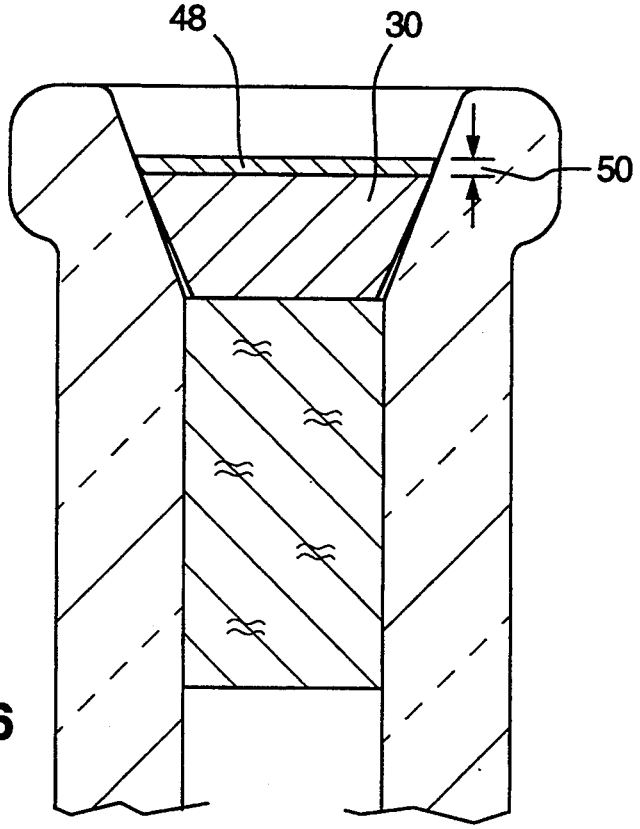
FIG. 6 is a cross-sectional view of a neck of a corked bottle showing a cork, the disc and a cover layer positioned therein according to one embodiment. The same reference numerals used in FIG. 4 are used in FIG. 6 to refer to the same elements.

In another embodiment of the present invention as shown in FIG. 6, an additional cover layer 48 may be used to cover the top of the disc 30 in both cylindrical and frusto conical disc embodiments. This additional cover layer 48 protects the disc 30 inside the bottle neck. The cover layer 48 also presents unlimited opportunity for design and decoration since the top of the cover layer 48 may be plain, embossed, printed or otherwise. The cover layer 48 may be made of paper of various weights or plastic.

There are various ways of securing the cover layer 48 to the top of the disc 30. If a hard wax is used, the cover layer 48 may be adhered to the disc 30, partially melted according to either of the heating methods described above. Thus, while the disc 30 is partially melted, the cover layer 48 may be placed upon the top surface of the disc 30 by hand or automatic dispenser so that when the disc 30 hardens, the cover layer 48 will be adhered to the top surface of the disc 30. Alternatively, a non-toxic adhesive can be used after the disc 30 is inserted into the bottle neck, heated and cooled.

If a soft, sticky wax is used, no partial melting of the disc or use of adhesives will be necessary. The cover layer 48 may simply be pressed onto the top surface of the disc 30 by hand or machine.

The selection of methods of adhering the cover layer to the top of the disc is within the skill of the ordinary artisan.

In practicing a preferred embodiment of the claimed invention, as seen in FIG. 6, the height 50 of the cover layer 48 may be selected so that the cover layer 48 is displaced entirely within the bottle neck. Ideally, the height 50 of the cover layer 48 is less than 1 mm. This permits the bottles to be stored and shipped upside down with each bottle suppported on the edge of the opening of the bottle neck without putting pressure on the cover layer 48. Although this is a preferred embodiment of the present invention, the height of the cover layer 48 may also be selected such that the cover layer 48 extends beyond the edge of the bottle opening.

While the present invention has been described in detail by way of illustration and example for purposes of clarity of understanding, it is understood that certain changes and modifications may be made within the spirit of the invention and the scope of the appended claims.

What is claimed is:

1. A combination comprising:

a) a corked bottle having a cylindrical neck terminating in a mouth having a top edge, said neck having a continuous cylindrical interior surface:

b) a solid cylindrical cork having a height, a continuous top flat surface, and a continuous bottom surface, wherein said top surface has a diameter and wherein said top surface is located at a distance from said top edge of said mouth, said cork being displaced entirely within said neck; and c) a solid preformed cylindrical disc having a top height less than said cork height, a top surface, a flat bottom surface having a diameter substantially equivalent to said cork top surface diameter, and an outer surface, said disc being displaced entirely within said neck above said cork, wherein said disc bottom surface is partially melted and removably secured to said cork top surface and wherein said disc outer surface is partially melted and removably secured to said interior neck surface, to create a seal to retain moisture within said cork and said bottle, and wherein said flat bottom surface of said preformed cylindrical disc in the partially melted condition maintains a diameter substantially equivalent to said cork top surface diameter.

2. The combination of claim 1 further comprising a cover layer having a height, said cover layer being displaced entierly within said neck above said disc, wherein said cover layer is adhered to said disc top surface.

3. The method of claim 2 wherein said cover layer is made of paper.

4. The method of claim 2 wherein said cover layer is made of plastic.

5. The method of claim 2 wherein the height of said cover layer is less than 1 mm.

6. The combination of claim 1 wherein said cork is displaced in said neck such that the distance from said cork top surface to said top edge of said mouth is at least 1 mm greater than the height of said disc.

7. The combination of claim 1 wherein the height of said disc is between 2 and 3 mm.

8. The combination of claim 1 wherein said disc is made of a thermoplastic material capable of melting at a temperature between 80 and 180 degrees Fahrenheit.

9. The combination of claim 1 wherein said disc is made of thermoplastic material selected from the group consisting of beeswax, granulate wax and mixture thereof.

* * * * *